US005748089A

United States Patent [19]

Sizemore

[11] Patent Number: 5,748,089

[45] Date of Patent: May 5, 1998

[54] PORTABLE PERSONAL SECURITY SYSTEM

[76] Inventor: Edric Sizemore, 325 W. 118th St., Chicago, Ill. 60628

[21] Appl. No.: 696,374

[22] Filed: Aug. 13, 1996

[51] Int. Cl.[6] ..... G08B 13/00

[52] U.S. Cl. ..... 340/574; 340/571; 340/568

[58] Field of Search ..... 340/571, 568, 340/574, 691; 116/693, 99, 77

[56] References Cited

U.S. PATENT DOCUMENTS

| | | | |
|---|---|---|---|
| 2,797,405 | 6/1957 | Stetler . | |
| 3,701,140 | 10/1972 | Dixon | 340/571 |
| 3,881,534 | 5/1975 | Gist | 150/33 |
| 3,893,096 | 7/1975 | Tucci et al. | 340/571 |
| 3,938,126 | 2/1976 | Ransom | 340/571 |
| 4,067,290 | 1/1978 | Hartley | 116/99 |
| 4,189,721 | 2/1980 | Doell | 340/574 X |
| 4,223,804 | 9/1980 | Morris et al. | 222/3 |
| 4,376,935 | 3/1983 | Castaldo | 340/571 |
| 4,484,181 | 11/1984 | Schwartz | 340/521 |
| 4,755,802 | 7/1988 | Urbanczyk | 340/571 |
| 4,759,309 | 7/1988 | Zediker | 116/67 R |
| 4,762,082 | 8/1988 | Sushevits | 116/87 |
| 4,821,026 | 4/1989 | Newsom | 340/574 |
| 4,843,371 | 6/1989 | Kuei et al. | 340/571 |
| 4,885,570 | 12/1989 | Chien | 340/574 X |
| 4,903,863 | 2/1990 | Fink | 222/61 |
| 5,022,340 | 6/1991 | Caraba | 116/77 |
| 5,389,916 | 2/1995 | Chen et al. | 340/571 X |
| 5,477,205 | 12/1995 | Burns | 340/332 |
| 5,512,881 | 4/1996 | Majmudar | 340/384.4 X |
| 5,587,701 | 12/1996 | Hess | 340/541 |

*Primary Examiner*—Jeffery Hofsass
*Assistant Examiner*—Anh La
*Attorney, Agent, or Firm*—Juettner Pyle Lloyd & Piontek

[57] ABSTRACT

A battery powered portable personal alarm system is contained within a bag having a carrying theft-resistant strap to avoid theft of the alarm system while being carried. The bag houses a siren and a visual signal generator located proximate openings therein for generating a loud distinguishable noise and a visual signal. An arming switch and panic switch allow simultaneously activation of the siren and the visual signal. The visual signal generator can be a spark flare and ignitor contained within a removable fire resistant chamber mounted on a base plate disposed within the bag. Installation of the fire resistant chamber simultaneously establishes the electrical connection of the fire resistant chamber, allowing convenient and fail-safe replacement of the spark flare and ignitor after use. The visual signal can also be a high intensity strobe lamp which emits a high-intensity and high frequency light signal through a visual window. The visual signal can also include a smoke generator for producing visible smoke. The panic switch can be a rotatable key lock switch, a key fob coupled with a activation receiver or an external panic button on exterior of the bag.

27 Claims, 2 Drawing Sheets

PORTABLE PERSONAL SECURITY SYSTEM

FIELD OF THE INVENTION

The present invention relates to a device for providing personal security. More particularly, the present invention relates to a portable personal security device having an audio and visual alarm for attracting attention to an emergency situation and being capable of being camouflaged as an ordinary accessory, such as a handbag or gym bag.

BACKGROUND OF THE INVENTION

In modern America and other places in the world, crime has reached epidemic proportions. Newspaper headlines daily chronicle this wave of violence against innocent citizens. This is no more so the case than in urban areas. One facet of these phenomena, among many, is the inability of law-abiding citizens to attract attention to themselves when confronted by a criminal intent on committing a violent act. This arises from the relative anonymity prevailing in today's society and the fact that many people are unknown to others.

Various strategies attempt to address the foregoing problem of inconspicuous crimes against persons, at least at the primary crime scene. For example, providing and remaining in well-lit areas and among crowds generally is considered a successful method of avoiding opportunistic criminals. However, it is not always possible to do so. Accordingly, various devices have been developed to decrease the inconspicuousness of persons away from their homes.

One such device reflecting a passive approach, taught by U.S. Pat. No. 3,881,534, includes a handbag provided with an detachable inner purse secured to a chain attached to the user. When a purse-snatcher attempts to forcibly steal the purse, the detachable inner purse holding the user's valuables remains attached to the user and defeats the objectives of the criminal. Although possibility contributing to "creating a scene" during the criminal event, such devices do not actively do so and accordingly do not effectively draw attention to the criminal act so that help can be summoned from other citizens or the police.

Another device is disclosed in U.S. Pat. No. 4,067,290 as an audible alarm coupled between a woman's purse and purse handle. A sudden force exerted on the purse handle activates the audio alarm, such as during a purse snatching event. However, the device is only operable during a purse snatching event and would be useless as a means of attracting attention for other, often more serious, crimes. Similarly, U.S. Pat. No. 4,759,309 discloses a hand-held audio alarm unit fueled by compressed gas that automatically activates when released, for example, through the sudden reaction of a crime victim. A drawback of this approach is that the automatic activation feature tends to promote false alarms and depletion of the compressed gas, possibly rendering it inoperative when needed.

Another approach is found in U.S. Pat. No. 4,224,804. There, a triggering mechanism for providing effective and fail-safe activation is combined with a flashlight, a compressed gas source and a noise generator, dispersed dye and/or an odoriferous spray. The major shortcoming of this approach, as with each of the foregoing examples of the personal alarms of the prior art, is that each device relies on only sound as the means to attract attention to the crime scene. Especially in noisy or congested areas, sound alone would not immediately attract attention to the crime scene, especially at a distance.

SUMMARY OF THE INVENTION

In accordance with the foregoing drawbacks associated with the state of the art prior as compared to the present invention, it is an object of the present invention to provide women and men with a means of portable personal security while away from home.

It is a further object of the present invention to provide a portable personal security system that will simultaneously emit audio and visual distress signals when activated.

It is another object of the present invention to provide a portable personal security system which, once activated, will continue to function despite a criminal's attempt to shut the unit off.

It is still a further object of the present invention to provide men and women with with the ability to carrying everyday items in a compartment of a personal security system.

Yet another object of the present invention is to provide users with a bag that contains a personal, multi-alarm distress system that can be seen and heard for over great distances.

A still further object of the present invention is to provide a portable personal security system provided with an anti-theft strap, such that the anti-theft strap prevents the personal security system from easily being taken from the user when activated.

These and additional objects of the present invention may be determined from a review of the instant disclosure, disclosing a portable personal security system having multiple distress signals for attracting attention to a crime scene. The system is powered by a battery pack and is contained within the body of a carrying bag having a carrying strap, an interior component compartment and a space for holding personal items. A siren and a visual signal generator are disposed within the component compartment proximate openings for generating a loud distinguishable noise and a visual signal. An arming switch is first placed in an "armed" position, such that a panic switch simultaneously activates the siren and the visual signal.

The visual signal generator preferably includes a spark flare and an ignitor electrically mounted on a base plate disposed within the component compartment and connected with the battery pack. The spark flare and the ignitor are contained within a removable fire resistant chamber electrically connected to the battery pack and the switches, such that attachment of the fire resistant chamber to the base plate simultaneously establishes the electrical connection of the fire resistant chamber to the battery pack, allowing convenient and fail-safe replacement of the spark flare and ignitor after use.

The visual signal can also comprise a high intensity strobe lamp electrically connected with the battery pack, whereupon actuation emits a high-intensity and high frequency light signal through the visual window. The visual signal can also include a smoke generator for producing visible smoke.

The panic switch is preferably a rotatable key lock switch located on the inner front side of the external skin of the bag, having an "on" and "off" position operated by a removable key. The system is activated only upon turning the key to the "on" position and can be deactivated upon turning the key to the "off" position. Alternatively, the panic switch can include a key fob having a pressure sensitive switch coupled with a activation receiver disposed within the component compartment, such that the system is activated only upon depression of the pressure sensitive switch and deactivated only upon turning the arming switch to the "unarmed" position. The system is preferable provided with a strap having a thin cable screwed into frame of the bag to avoid theft of the portable personal security system while being carried.

Other objects, advantages and features of the invention will become apparent upon a consideration of the following detailed description, when taken in conjunction with the accompanying drawings.

DETAILED DESCRIPTION OF THE PREFERRED EMBODIMENT

The following is a description of the best mode presently contemplated for carrying out the invention. Other modes of carrying out the invention, without departing from the scope of the invention, will become apparent to those skilled in the art as the description proceeds.

Figure 1:
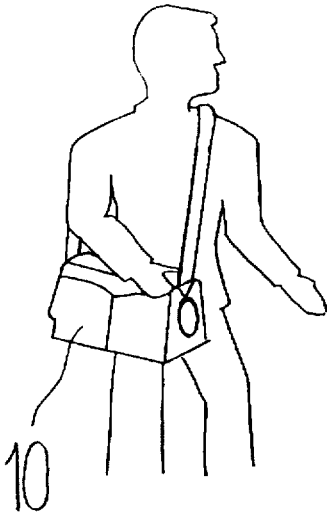
FIG. 1 is a perspective view of the portable personal security system of the present invention as carried by a user.
Figure 2:
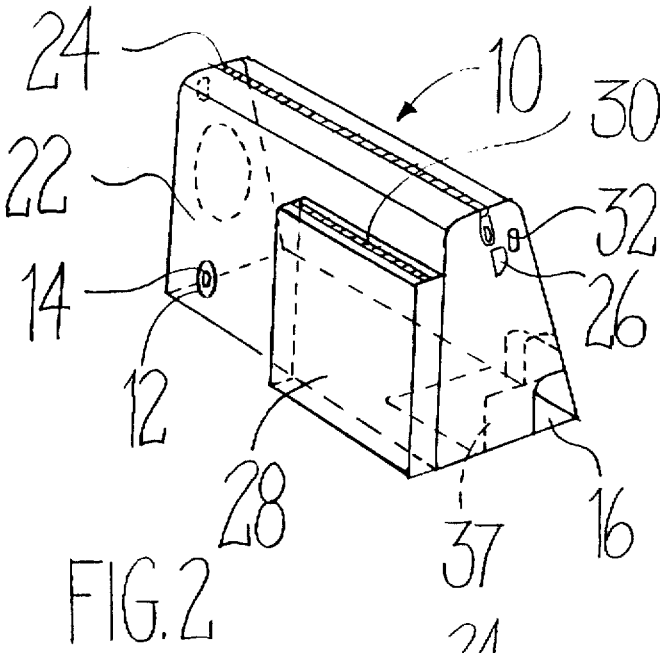
FIG. 2 is a perspective view of a first side of the portable personal security system of the present invention.
Figure 3:
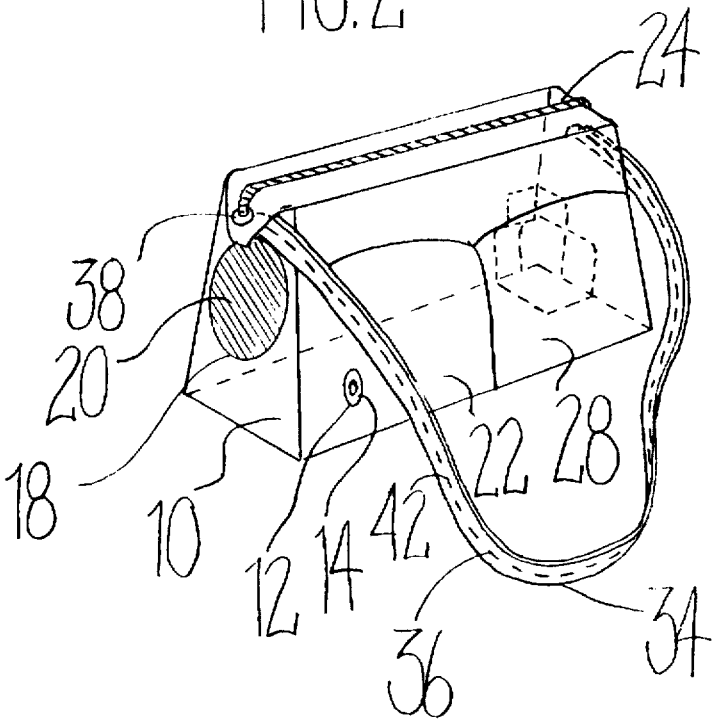
FIG. 3 is a perspective view of a side of the portable personal security system of the present invention.

Referring to FIGS. 1 through 3, a leather bag 10 is shown for application of the present invention. Although sizes can vary, the preferably size is 13 inches by 8½ inches by 4½ inches. Also, although a woman's handbag is herein disclosed, other bags, such as gym bags, backpacks, knapsacks and fanny belts, can beneficially accommodate the portable personal security system of the present invention. As best shown in FIG. 2, a hole 12, preferably a circular opening, is provided in the bag 10 within which is situated a rotatable key lock panic switch 14 having an "on" and "off" position and a removable key. A distress signal window 16 is provided, also preferably as a small circular opening, in the back outer comer of the bag 10. A siren window 18, preferably a larger circular opening, is situated on the front of the bag 10 and is covered by a siren window screen 20, preferably fabricated of thin speaker cloth, covering the siren window 18.

A component compartment 22, discussed herein below, is provided within the bag 10 and a zipper 24 is situated to close and fasten the top of the bag 10 and the component compartment 22. A key-type zipper lock 26 is preferentially provided to allow locking of the component 22. A second carrying compartment 28 can be used to carry everyday personal items and is similarly fastened closed with a zipper 30. The size and placement of the second carrying compartment 28 can, of course, vary according to the nature and styling requirements of the bag 10. Front and back strap holes 32 accept two screws (not shown) having steel hoops 38, 40 for fastening a strap 34 to the bag 10 at opposite ends for carrying the bag 10. The strap 34 is preferentially provided with an internal wire cable 36. Exterior padding 42 around the anti-theft wire cable 36 increases the comfort of carrying the bag 10.

Figure 4:
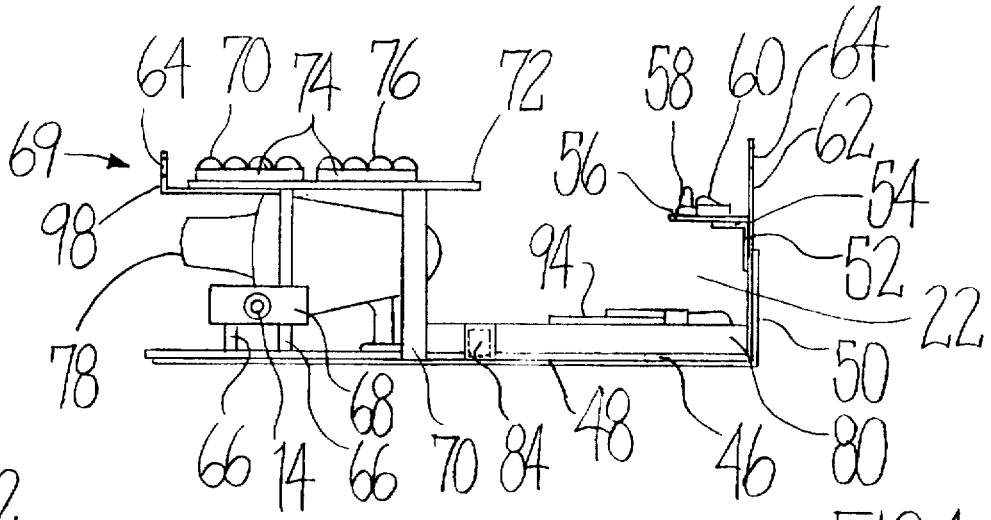
FIG. 4 is a cross-sectional view of the interior component compartment of the portable personal security system of the present invention.
Figure 6:
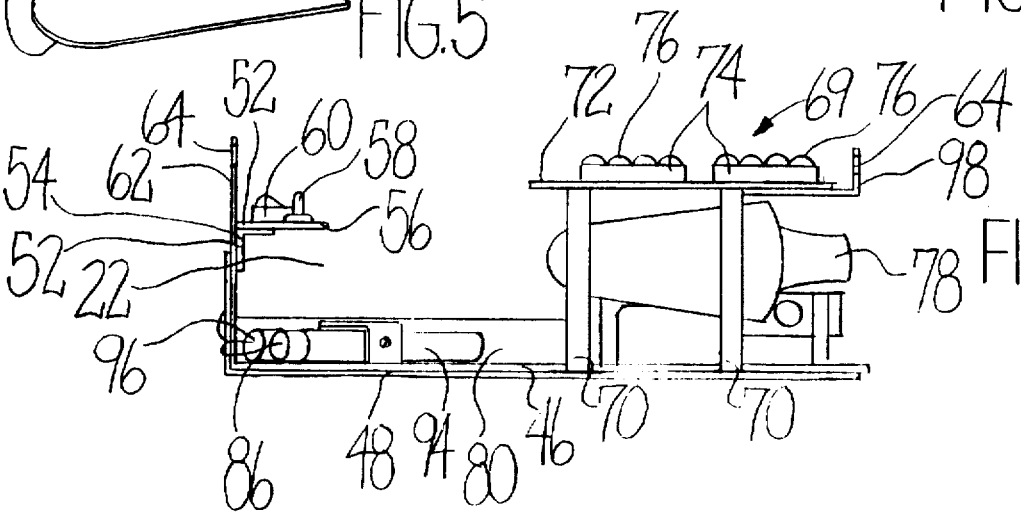
FIG. 6 is a reverse cross-sectional view from FIG. 4 of the interior component compartment of the portable personal security system of the present invention.
Figure 7:
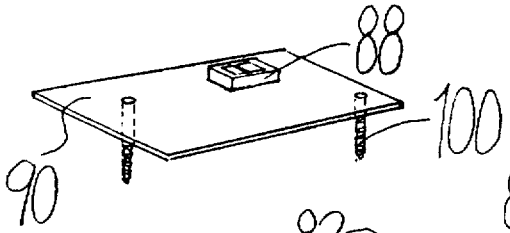
FIG. 7 is a perspective view of the fire resistant compartment of the portable personal security system of the present invention.
Figure 7:
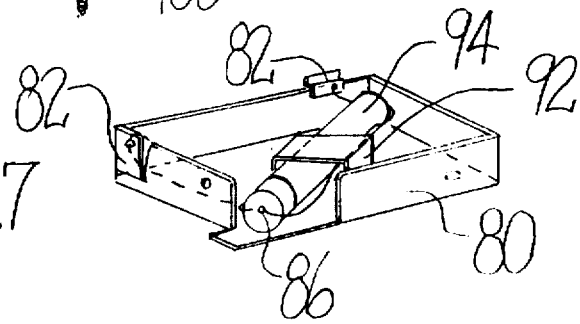

In accordance with the preferred embodiment of the present invention, a fire resistant aluminum shield 37 lines the bottom of the component compartment 22 proximate the distress signal window 16, which as discussed below forms the base for a fire resistant compartment. As best seen in FIGS. 4 and 6, the component compartment 22 is provided with a base 46 having a length and width roughly that of the bag 10. The base 46 is preferably fabricated of wood (for lower weight and combustion resistance) and is attached by screws at its bottom surface to a brace 48 manufactured from a formable metal strip shaped in a 90 degree angle. The brace 48 thus also extends vertically along the back side of the bag 10 (proximate the distress signal window 16) to form a back corner brace 50. A mounting brace 62 is attached to the back comer brace 50, to which is further attached a switch brace 52 as a horizontally orientated metal section attached by screws to and near the top of the back comer brace 50 and to the mounting brace 62. Corner brace extensions 54 comprise two 90 degree angled short metal sections likewise attached by screws both to the switch brace 52 and to the bottom of a switch base 56. The switch base 56 is a rectangular section supporting an arming switch 58 and a system power test button 60, as will be discussed below. The mounting brace 62 also include a tapped strap brace hole 64 aligned with the strap hole 32.

Also attached by screws to the base 46 and the brace 48 are two key braces 66, which are two 90 degree angled metal sections. A key base 68, a small rectangular section, is screwed to key braces 66 for supporting the activating rotatable key panic switch 14, which controls a 12 volts battery power pack 69 to power the audio and visual signals of the present invention, the system being activated only upon turning the key to the "on" position with the system armed and deactivated upon turning the key to the "off" position or placing the arming switch 58 to the "off" position.

Battery braces 70 are fabricated from two vertical, formable metal sections screwed into the bottom of the base 46 and extend vertically upward to support a battery base 72. Battery base 72 is preferably a seven (7) inch long metal plate screwed to the battery braces 70. Two cases 74 each hold preferably four (4) AA 1.5 volt batteries and are each attached to the battery base 72. Thus eight (8) AA batteries 76, connected in series, are available to generate 12 volts of electricity for the system.

A siren horn 78 is screwed to a front section of the base 46 and brace 48. The siren 78 is preferably an electric siren obtained from Tandy Corporation, located in Fort Worth, Tex., as Model No. 49-488f. As is known, applying electrical power to the siren via panic switch 14 provides the system with the audio signal according to the present invention, which is communicated to the outside world and the criminal via sound opening 18. Alternatively, the siren horn 78 can be a compressed gas type with a suitable triggering mechanism.

A visual effect cartridge 80 is a rectangular fire resistant compartment within which the visual signaling effects are placed. As a particularly beneficial aspect of the present invention, the cartridge 80 is removable, so that a spent cartridge 80 can be readily replaced. The cartridge 80 is provided with two cartridge connectors 82, one being a positive line connected to a positive terminal of an ignitor 86 and to a positive terminal of an effects cartridge power test button 88 and a second connector being a negative line connected to the negative terminals of each of the ignitor 86 and effects cartridge power test button 88. Two base connectors 84 are metal slots mounted to the base 46 and brace 48, and serve as inputs for the visual signal effect conductor connectors 82. One of the base connectors 84 is electrically connected to the positive terminal of the panic switch 14 and the other of the base connectors 84 is electrically connected to the negative terminal of the batteries 76. The cartridge connectors 82 are mounted on adjacent sides of the cartridge 80, and are shaped to provide tension, for a solid connection, when fitted onto two base connectors 84. Thus, the cartridge 80, during replacement, readily locks into position for a fail-safe installation. The effects cartridge power test button 88, mounted on the top of an aluminum fire-resistant lid 90, is used to indicate to the user that the cartridge 80 is properly installed and connected.

An effects brace 92, fabricated from a formable metal strip, secures a spark flare 94 to the cartridge 80. Optionally, a smoke effect source 96 can be similarly mounted. The spark flare 94, and optionally the smoke effect source 96, are ignited by the ignitor 86 when the panic switch 14 is placed in the "on" position, whereupon the spark flare 94 provides a 20 second spark fountain shooting preferably between 8 and 12 feet from bag 10 through the distress signal window 16. The optional smoke generator 96 preferably provides a 5 to 10 second smoke signal. The spark flare 94, smoke effect source 96 and ignitor 86 are manufactured and/or distributed by Luna Tech, Inc. located in Owens Cross Road, Ala. The ignitor 86 is a covered electrical wire with an exposed "U" shaped wire tip fitting into the spark flare 94 and, if present, fitting into the smoke generator 86. When an electrical signal is received, the wire tip ignites the spark and smoke effects.

Alternatively, the visual signal can be obtained through a high intensity strobe lamp similarly connected to the battery pack, whereupon actuation produces a high-intensity and high frequency light signal through the distress signal window 16. This visual signal can also include a smoke generator for producing visible smoke.

An additional feature which may be included in the portable personal security system of the present invention, especially with a high intensity strobe lamp as the visual signal, can include one or more small cameras and, if necessary, camera flash units preferably located proximate the visual distress window 16. In addition to simultaneously activating the audio and visual distress signals, the system could also potentially provide the user with a photograph of the criminal for use as physical evidence at a later time. Alternatively, additional visual windows 16 can be provided as necessary, preferably on the front and exposed side surfaces of the bag 10, exposing the cameras and flash units to the maximum field of view possible. Flaps normally fixed closed by Velcro could be used to maintain the appearance of bag 10.

Figure 5:
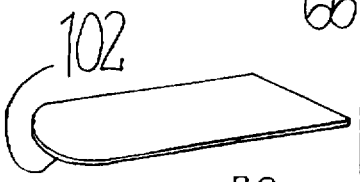
FIG. 5 is a perspective view of the battery cover of the portable personal security system of the present invention.

A front strap brace 98 is formed from a formable metal section attached to the bottom of the battery base 72. A 90 degree front section of the front strap brace is similarly provided with tapped hole 64 for attaching the strap 36. The lid 90 of the cartridge 80 is held in place by screws 100. A battery cover 102, shown in FIG. 5, provides a thin rectangular cover for the batteries. It is preferably held in place by Velcro fasteners for ready replacement of the system batteries 76.

Functionally, each distress signal device located in the bag has a positive lead and a negative lead. The positive lead from the batteries 76 are connected to the positive terminal of the arming switch 58 and the system power test button 60. The negative terminal of the arming switch 58 is then connected to the negative terminal of the panic switch 14. The positive terminal of panic switch 14 is split into two leads, one each to the positive terminals of the ignitor 86 and the siren 78. The negative terminals of each of the ignitor 86 and siren 78 are then connected to the battery's negative line, along with the negative terminals of the system power test button 60.

In operation, the portable personal security system of the present invention is easy to operate with high effectiveness. Preferably, if incorporated into a woman's handbag, it is worn near the waist with the shoulder strap extending across the torso and over the shoulder opposite the side whereon the device is carried. This provides the user with easy excess to the panic turn key switch 14. Before using the alarm bag, the bag zipper 24 is unlocked and zipped open, exposing the component compartment 22 and the arming switch 58, the system power test button 60 and the effects cartridge power test button 88. Depressing the system power test button 60 tests the charge of the batteries 76 and depressing the effects cartridge power test button 88 tests the electrical connections of the cartridge, whereupon, if all is satisfactory, preferably a red lamp in each is activated. To disable the power test circuits, the power test buttons 60, 88 are again depressed. Next, the arming switch 58 is placed in the "on" position. The portable personal security system of the present invention is now armed and ready for use. The bag 10 is then zipped closed.

To use the now armed portable personal security system of the present invention, the user inserts a key into the panic switch 14. While in a potentially dangerous environment, one hand is kept on the key at all times. When the user feels threatened, the user simply turns the panic switch 14 clockwise, as quickly as possible, to close the circuit to the siren 78 and effects cartridge 80. The siren is activated and begins to emit a loud distinctive noise through the sound window 18, preferably at least about 105 decibels, while the ignitor 86 ignites the spark flare 94 (and optional smoke generator 96) providing a signal visible from more than 200 yards away from the crime scene. After the alarm has been activated, the user removes the key, preventing the criminal from quickly turning off the siren.

Alternatively, the rotatable key lock panic switch 14 can be replaced with a hand-held remote key fob having a pressure sensitive panic switch coupled with a activation receiver disposed within the component compartment 22 or simply a panic button on the exterior of the bag. The system is activated only upon depression of the pressure sensitive panic switch or the exterior panic button with the system armed and deactivated only upon turning the arming switch 58 to the "unarmed" position.

After use of the preferred embodiment of the portable personal security system of the present invention described above, it is recommended that the user allow the effects cartridge 80 to cool. Later, in a well ventilated area, the user can remove the effects cartridge 80, place the spent effects cartridge 80 into an air tight bag for later processing and install a new effects cartridge 80 onto the base 46 and frame 48 through the connectors 82, 84. It is envisioned that the used effects cartridge 80 be returned to a local retailer, whereupon the user may purchase a replacement effects cartridge as a spare.

The portable personal security system of the present invention will increase the likelihood of women and men escaping violent crimes and reduce purse snatching, as well as deter criminals by providing users with several simultaneous distress alarm signals heard and seen from great distances from the crime scene. These signals will inform any and every person, preferably within a 200 yard radius, that the user is being threatened, therefore warding the perpetrator away from the scene and promoting assistance from fellow citizens or law enforcement officials.

The objects and advantages of the invention have been shown to be attained in an economical, practical and facile manner. To wit, persons requiring effective personal security may now avail themselves of an immediately available audio and visual alarm device which may be conveniently carried and camouflaged as an ordinary accessory.

While embodiments of the invention have been herein illustrated and described, it is to be appreciated that various changes, rearrangements and modifications may be made therein, without departing from the scope of the invention as defined by the appended claims.

What is claimed:

1. A portable personal security system having a carrying strap and a compartment within which personal items may be carried, said compartment having an opened and closed position, the system comprising:

audio alarm generating means for emitting an audio alarm when activated;

visual alarm generating means for emitting a conspicuous and highly visible visual signal when activated; and an externally accessible alarm panic switch having a activated and inactivated position for selectably and simultaneously activating the audio alarm means and the visual alarm means when the compartment is in the closed position to attract the attention of nearby persons.

2. The portable personal security system of claim 1, wherein the visual alarm generating means comprises a light source disposed proximate a visual window on an external surface of the system for emitting a conspicuous and highly visible visual signal when activated.

3. The portable personal security system of claim 2, wherein the visual signal generator comprises a spark flare and an ignitor, whereby positioning the panic switch in the activated position generates a spark fountain through the visual window.

4. The portable personal security system of 3, wherein the system further comprises:

a battery power pack;

an interior component compartment;

a base plate disposed within the interior compartment;:

a system electrical connector electrically connected to the battery power pack and the panic switch; and a removable fire resistant chamber within which the spark flare and the ignitor are contained and to which the spark flare and the ignitor are electrically connected, the fire resistant chamber being adapted for attachment to the base plate proximate the visual window and having an electrical connector adapted for establishing an electrical connection with the system electrical connector.

5. The portable personal security system of claim 4, wherein the system electrical connector is disposed on the base plate, such that attachment of the fire resistant chamber to the base plate simultaneously establishes the electrical connection of the fire resistant chamber to the system electrical connector.

6. The portable personal security system of claim 2, further comprising a battery power pack, the visual signal generator comprising a high intensity strobe lamp electrically connected with the battery power pack and the panic switch, whereby positioning of the panic switch to the activated position causes the emission of a high-intensity and high frequency light signal through the visual window.

7. The portable personal security system of claim 1, wherein the audio alarm generating means comprises a siren disposed proximate a sound opening on an external surface of the system for emitting an audio alarm when activated.

8. The portable personal security system of claim 7, wherein the system further comprises a battery power pack in electrical communication with the panic switch, the siren and the visual alarm generating means, such that placing the panic switch in the activated position simultaneously activates the audio alarm means and the visual alarm means.

9. The portable personal security system of claim 1, wherein the system further comprises a battery power pack in electrical communication with the panic switch and the visual alarm generating means, such that placing the panic switch in the activated position simultaneously activates the audio alarm means and the visual alarm means.

10. The portable personal security system of claim 1, wherein the panic switch comprises a rotatable key lock switch having an "on" and "off" position and a removable key, the system being activated upon turning the key to the "on" position and deactivated upon turning the key to the "off" position.

11. The portable personal security system of claim 1, further comprising an arming switch having an "armed" and "unarmed" position, such that placing the panic switch in the activated position simultaneously activates the audio alarm means and the visual alarm means only when the arming switch is in the "armed" position.

12. In combination with a shoulder bag for carriage by a user of the type having a carrying strap and a compartment for carrying personal items having a closed and open position, a personal alarm system disposed within the shoulder bag comprising a visual alarm generator, an audio alarm generator, an arming switch and an external alarm actuator for selectively and simultaneously activating the visual alarm generator and audio alarm generator, the shoulder bag having a noise opening and visual distress signal window, wherein activation of the audio alarm generator produces an audio alarm signal through the noise opening and activation of the visual alarm generator generates a conspicuous and highly visible visual signal through the visual distress signal window when the compartment is in the closed position to attract the attention of nearby persons.

13. The invention of claim 12 wherein the shoulder bag is a woman's purse.

14. A multi-distress signal portable personal security system for attracting attention to a crime scene, the system comprising:

a carrying bag defined by a body portion having an interior component compartment, a container for holding personal items having a closed and open position, an external outer skin having a sound opening and a visual window and a carrying strap;

a siren disposed within the interior component compartment proximate the sound opening for generating an audio alarm;

a visual signal generator disposed within the interior component compartment proximate the visual window for generating a conspicuous and highly visible visual signal for attracting the attention of nearby persons;

a battery power pack deposed within the interior component compartment for selectively supplying power to the siren and the visual signal generator;

an arming switch disposed within the interior component compartment having an "armed" position for enabling the system and an "unarmed" position for disabling the system; and a panic switch operatively connected to the battery power pack and each of the siren and visual signal generator for simultaneously activated the siren and the visual signal generating when the compartment is in the closed position, such that with the arming switch in the "armed" position and upon activation of the panic switch, the siren generates an audio alarm through the sound opening and the visual signal generate displaces a visual signal through the visual window.

15. The invention of claim 14, wherein the visual signal generator comprises a spark flare and an ignitor electrically connected with the battery power means, the arming switch and the panic switch, whereby actuation of the system generates a spark fountain through the visual window.

16. The invention of claim 15, wherein a base plate is disposed within the interior compartment, the system further comprising:

a system electrical connector electrically connected to the battery power pack, the arming switch and the activation switch; and a removable fire resistant chamber within which the spark flare and the ignitor are contained and to which the spark flare and the ignitor are electrically connected, the fire resistant chamber being adapted for attachment to the base plate proximate the visual window and having an electrical connector adapted for establishing an electrical connection with the system electrical connector.

17. The invention of claim 16, wherein the system electrical connector is disposed on the base plate, such that attachment of the fire resistant chamber to the base plate simultaneously establishes the electrical connection of the fire resistant chamber to the system electrical connector.

18. The invention of claim 14, wherein the visual signalling generator further includes a smoke generator for producing visible smoke when actuated.

19. The invention of claim 14, wherein the visual signal generator comprises a high intensity strobe lamp electrically connected with the battery power means, the arming switch and the panic switch, whereby actuation of the system the high-intensity light source emits a high-intensity and high frequency light signal through the visual window.

20. The invention of claim 14, wherein the panic switch comprises a rotatable key lock switch having an "on" and "off" position and a removable key, the system being activated only upon turning the key to the "on" position and deactivated only upon turning the key to the "off" position.

21. The invention of claim 20, wherein the panic switch is disposed on the external skin of the bag.

22. The invention of claim 21, wherein the panic switch is located on a front inner side of the bag.

23. The invention of claim 14, wherein the system further comprises a transmission receiver disposed within the component compartment and the panic switch is a pressure sensitive switch disposed on a separate hand-held remote control battery powered transmitter, the system being activated upon depression of the pressure sensitive switch and deactivated upon turning the arming switch to the "unarmed" position.

24. The invention of claim 14, wherein the strap contains a thin cable that screws into the bag to avoid theft of the alarm system while in use.

25. The invention of claim 14, further comprising a camera disposed within the interior compartment having a field of view external to the carrying bag, the camera being activated upon actuation of the panic switch.

26. The invention of claim 25, wherein the carrying bag has a camera opening through the external outer skin, the camera being disposed proximate the camera opening.

27. The invention of claim 25, further comprising a flash unit operatively connected to the camera, whereupon activation of the panic switch simultaneously activates the camera and the flash unit.

* * * * *